US006624368B2

(12) United States Patent
Sato et al.

(10) Patent No.: US 6,624,368 B2
(45) Date of Patent: Sep. 23, 2003

(54) SWITCH DEVICE

(75) Inventors: Dai Sato, Fussa (JP); Toshikatsu Nishi, Iruma (JP); Kazuhiko Endo, Higashimurayama (JP); Mikio Nakayama, Musashino (JP); Takuo Watanabe, Iruma (JP)

(73) Assignee: TEAC Corporation, Tokyo (JP)

( * ) Notice: Subject to any disclaimer, the term of this patent is extended or adjusted under 35 U.S.C. 154(b) by 0 days.

(21) Appl. No.: 10/205,653

(22) Filed: Jul. 24, 2002

(65) Prior Publication Data

US 2003/0019734 A1 Jan. 30, 2003

(30) Foreign Application Priority Data

Jul. 25, 2001 (JP) ..... 2001-224019

(51) Int. Cl.[7] ..... H01K 9/10

(52) U.S. Cl. ..... 200/310; 200/5 R; 200/317; 362/28

(58) Field of Search ..... 200/5 R, 308, 200/310–317; 362/28–30

(56) References Cited

U.S. PATENT DOCUMENTS 5,464,955 A * 11/1995 Cole ..... 200/317
5,747,759 A * 5/1998 Lochmahr et al. ..... 200/5 R
6,155,691 A * 12/2000 Miyasaka ..... 362/30
6,207,913 B1 * 3/2001 Nakajima et al. ..... 200/314
6,479,769 B1 * 11/2002 Barat et al. ..... 200/5 R

FOREIGN PATENT DOCUMENTS

JP 2001-78300 3/2001 ..... H04S/7/00

* cited by examiner

*Primary Examiner*—Michael Friedhofer
(74) *Attorney, Agent, or Firm*—Christensen O'Connor Johnson Kindness PLLC

(57) ABSTRACT

A switch device is provided which allows easy recognition of the operation amount of the switch device with an inexpensive structure and without the need for an operator to change the posture or the like, even when a blind spot region is generated in an indicator as a special indication region at the time of indicating the operation amount of the switch. When the special indication region on the indicator cannot be seen directly because it is blocked by a knob, the state of the indicator in the special indication region is expressed using a visible region on the indicator which is always visible. Thus, the operator can recognize the operation amount of the switch device in the blind spot region without changing the posture or the like and using a simple structure of the switch device.

18 Claims, 7 Drawing Sheets

SWITCH DEVICE

BACKGROUND OF THE INVENTION

1. Field of the Invention

The present invention relates to a switch device, and more particularly to an improved a switch device having an indicator for indicating an operation amount of a switch.

2. Description of Related Art

Switch devices are conventionally used for setting an amount of control for various devices. For example, rotary volume switches and sliding switches are widely used. FIG. 6 shows a mixer device 100 used for recording, which is one example of an operation panel in which a large number of such switch devices are arranged. In such a mixer device 100, because it is necessary to visually recognize the operation amount of many switch devices instantaneously, an indicator 102 capable of showing visually noticeable change is often provided. In particular, for a mixer device 100 often used in a dimly-lighted room, a light emitting indicators 102 which allows quick judgment of the operation amount (the amount or level to which a switch device has been operated, moved, or adjusted) are widely used, because such indicators are easier to recognize and costs less to manufacture than number display type switches, for example.

As an example, FIGS. 7A and 7B illustrate a switch structure including a rotary volume switch (hereinafter simply referred to simply as a "switch") 104 and an indicator 102 including a plurality of LEDs 102*a* arranged in a circle around the switch. More specifically, FIG. 7A shows an example in which the position of a lit LED 102*a* is sequentially moved in accordance with the operation amount of an operation knob (hereinafter simply referred to as a "knob") 104*a* of the switch 104. The operation amount of the knob 104*a* corresponds to an operation amount of the switch 104. In the example shown in FIG. 7A, an LED 102*at* (at the apex position) is lit in accordance with the amount of operation of the knob 104*a*. FIG. 7B shows another example in which a single LED 102*a* indicating a special condition of the switch 104, such as a point which requires particular attention including a predetermined threshold or the like of the switch 104 (hereinafter, such a point will be referred to as an "attention point"), continuously lights up, whereas another LED 102*a* sequentially lights up in accordance with the operation amount of the knob 104*a*. In the example shown in FIG. 7B, the LED 102*at* (at the apex position), which serves as an attention point, is continuously lit to indicate the threshold value, and the LED 102*ap* next to the LED 102*at* on the right side also lights up for indicating the operation amount of the knob 104*a*.

Similar type of switch devices which are provided with such an indicator are also used in, for example, an operation panel in the cockpit of an air plane and operation panels for various devices installed in a vehicle. In any of these cases, it is necessary to quickly and easily recognize visually the operation amount of the switch device.

While mixer devices 100 shown in FIG. 6 come in a wide range of sizes, a typical device may have a width of 1 m or more and a depth of approximately 0.6 m. An operator operates the mixer device 100 while he/she is sitting or standing at approximately the midpoint in front of the mixer device 100. This causes a problem that for a switch 104 having a knob 104*a* with a predetermined height as shown in FIGS. 7A and 7B, part of the indicator 102 is concealed behind the knob 104*a* itself. In other words, the knob 104*a* may generate a blind spot region in the indicator 102. In FIG. 7C, which corresponds to FIG. 7A, LED 102*a* which lights up to indicate the operation amount (LED 102*at*) is completely within the blind spot region, and cannot be seen by the operator. In FIG. 7D, which corresponds to FIG. 7B, because the operation amount of the knob 104*a* increases, lit LED 102*a* is now moved to the LED 102*ap*. While part of the LED 102*ap* is out of the blind spot region and is now visible in the example shown in FIG. 7D, such a point of view may change depending on the position of the switch 104, the standing position or physique of the operator, and the like. Therefore, the blind spot region may also change, which would put LED 102*at* and also LEDs 102*a* on both sides of LED 102*at* (i.e., total of three LEDs) completely within the blind spot region, thereby lowering the visibility of the indicator 102. Further, when the attention point as described above is within the blind spot region, there is, of course, a problem that a point which requires particular attention cannot be recognized. Even when such an attention point is located outside the blind spot region, however, there is still a possibility that a change of the point of view makes it difficult to decide whether the operation amount of the switch 104 has exceeded the attention point. The visibility of the indicator 102 is similarly lowered in this case. Thus, there has been a demand that devices allow easy and accurate recognition as to whether indication of the indicator 102 has reached the special indication region indicative of a specific operation amount (such as the blind spot or the attention point) or the state (the indication position) of the indicator 102 in the special indication region. This enhanced visibility of the indicator is especially strongly desired for an operation panel on which a plurality of switches, indicators, and other various instruments are disposed. When it is necessary to simultaneously monitor a plurality of switches, indication lights, indication meters or the like, it is desirable that they can be monitored by moving just the users focus of attention, while minimizing any need to change posture.

Further, when the indicator 102 is placed at a distance from the knob 104*a*, the problem of the blind spot region as described above can be eliminated. However, an operation panel on which the switch 104, the indicator 102 and other instruments are disposed has a limited space, and formation of an extra space in such a panel will decrease in the number of switches or the like which can be disposed on the panel or increase the size of the operation panel. Also, provision of the switch 104 and the indicator 102 at a distance is not preferable because there is a possibility that the relevance between them will be less recognizable or that their visibility will be decreased.

SUMMARY OF THE INVENTION

The present invention was conceived in view of the aforementioned problems of the related art and aims to provide a switch device enabling easy recognition of an operation amount of a switch device with an inexpensive structure and without the need for an operator to change their posture, even when the visibility of the indication of the operation amount by an indicator is obstructed in a special indication region generated as a part of the indicator in the switch device during the indication of the operation amount by the indicator.

In order to achieve the foregoing object, in accordance with one aspect of the present invention, there is provided a switch device comprising an operation knob for a switch; an indicator whose indication state is changed in accordance with an operation amount of the operation knob, the indicator including a special indication region indicating a specific operation amount of said switch and a visible region which is always visible; and a control section for controlling such that the indication state of the indicator is sequentially changed in accordance with the operation amount of the operation knob, the control section changing the indication state in part of the visible region when the change of the indication state of the indicator reaches the special indication region.

Further, in order to achieve the foregoing object, in accordance with another aspect of the present invention, there is provided a switch device comprising an operation knob for a volume switch; an indicator disposed around said operation knob, whose indication state is changed in accordance with an operation amount of the operation knob, the indicator including a special indication region indicating a specific operation amount of said volume switch and a visible region which is always visible; and a control section for controlling such that the indication state of the indicator is sequentially changed in accordance with the operation amount of the operation knob, the control section changing the indication state in part of the visible region when the change of the indication state of the indicator reaches the special indication region.

Here, the indicator may be composed, for example, of a plurality of LEDs, and the control section can control lighting-up of the LEDs in synchronization with the operation amount of the operation knob and also can control lighting-up of the LEDs at arbitrary positions individually. It should be noted that the special indication region and the visible region are determined within a range between the minimum and maximum operation amount of the operation knob.

With the above structure, the fact that lighting-up of the indicator occurs in the special indication region on the indicator or the state of lighting in the special indication region is expressed in the visible region which is easy to recognize. It is therefore possible to recognize the operation amount of the switch indicated in the special indication region with a simple structure.

Further, in accordance with another preferred aspect of the present invention, the special indication region includes a blind spot region in which the indication is obstructed by the operation knob as seen from an operator of the switch device, and said control section changes the indication state of part of the visible region when the change of the indication state of the indicator reaches the blind spot region.

With this structure, even when the portion of the indicator which actually indicates the operation amount of the switch is completely blocked from the operator's view, such indication state can be expressed in the visible region. Accordingly, the operation amount of the switch which is indicated in the blind spot region can be recognized with a simple structure.

Further, in accordance with another preferred aspect of the present invention, the special indication region includes an attention point indicative of a specific operation state of the switch.

Here, the attention point refers to an operation amount of the switch which requires particular attention, such as a threshold value for the prescribed operation amount, and may represent an appropriate operation amount or an operation neutral point.

With this structure, it is possible to indicate a position which is significant for the switch operation more clearly using the visible region, which enables simple and reliable recognition.

Further, in accordance with another preferred aspect of the present invention, said control section uses the visible region to indicate the indication state of the indicator in the special indication region.

For example, when the special indication region covers a wide range, change within the special indication region can be expressed in the visible region in the same manner, so that the state in the special indication region can be recognized with higher accuracy.

Further, in accordance with another preferred aspect of the present invention, the indication state of part of the visible region is changed by using part of the visible region including end portions when the change of the indication state of the indicator reaches the special indication region.

Because end portions of a region generally have high degree of visibility, improved visibility can be obtained Further, in accordance with another preferred aspect of the present invention, the indication state of part of the visible region is changed by controlling lighting-up of the indicator at a predetermined position, when the change of the indication state of the indicator reaches the special indication region.

Further, in accordance with another preferred aspect of the present invention, the indication state of part of the visible region is changed by controlling blinking of the indicator at a predetermined position, when the change of the indication state of the indicator reaches the special indication region.

Further, in accordance with another preferred aspect of the present invention, the indication state of part of the visible region is changed by controlling driving of a plurality of elements which constitute the indicator, when the change of the indication state of the indicator reaches the special indication region.

With these structures, the state of the indicator in the special indication region can be expressed in the visible region in a proper and simple manner, so that the visibility can be increased.

Further, in accordance with another preferred aspect of the present invention, the control section causes the indication states of the visible region to vary for each of cases wherein the change of the indication state of the indicator does not reach the attention point after the change reaches the special indication region, wherein the change of the indication state of the indicator reaches the attention point after the change reaches the special indication region, and wherein the change of the indication state of the indicator passes the attention point after the change reaches the special indication region.

For example, before the attention point is reached, an LED in the front side of the visible region is caused to blink or light up. After the attention point is passed, an LED in the passing side of the visible region is caused to blink or light up. When the change of the indication state corresponds exactly to the attention point, the LEDs in both the front and passing sides of the visible region are caused to blink or light up.

With this structure, it is possible to accurately express the actual operation state of the indicator near the attention point using the visible region, thereby increasing the visibility concerning the attention point easily.

It should be noted that while the present invention will be understood more clearly with reference to the preferred embodiment as will be described below, the scope of the present invention is not limited to the following embodiment.

BRIEF DESCRIPTION OF THE DRAWINGS

These and other objects of the invention will be explained in the description below, in connection with the accompanying drawings, in which.

DETAILED DESCRIPTION OF THE PREFERRED EMBODIMENT

A preferred embodiment of the present invention will be described with reference to the drawings.

Figure 1A:
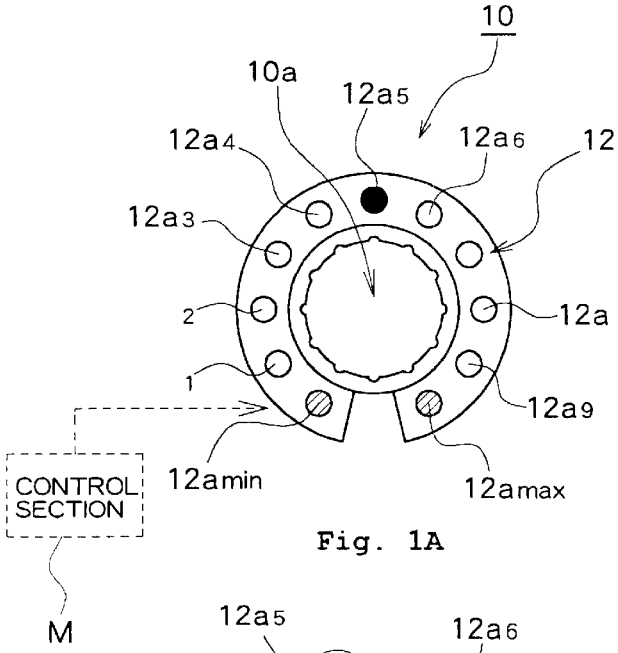
FIG. 1A is a top view showing an example of the operation amount of a switch device according to an embodiment of the present invention reaching a blind spot region.
Figure 6:
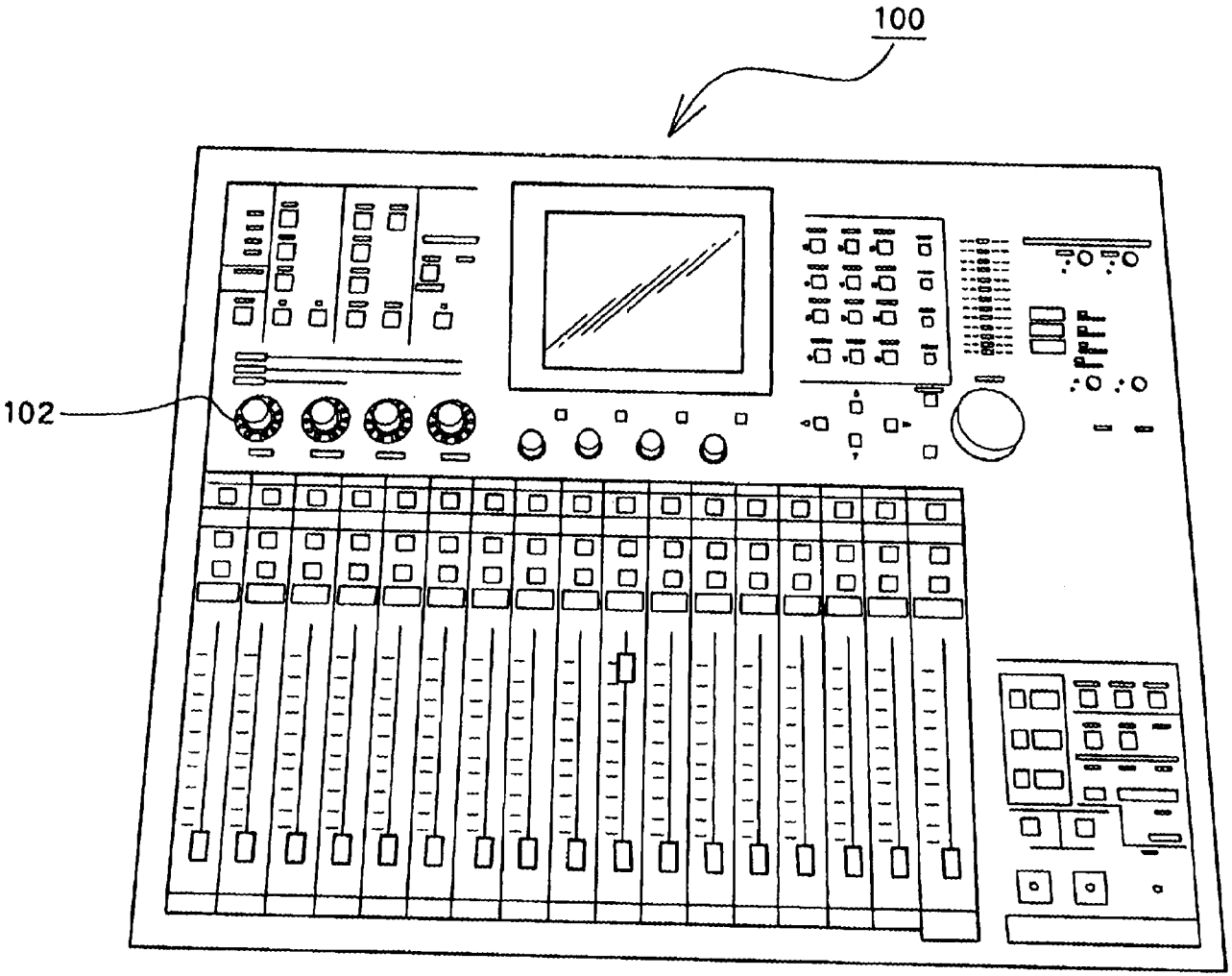
Fig. 6 (PRIOR ART)
FIG. 6 is a explanatory view showing the appearance of a mixer device.
Figure 7A:
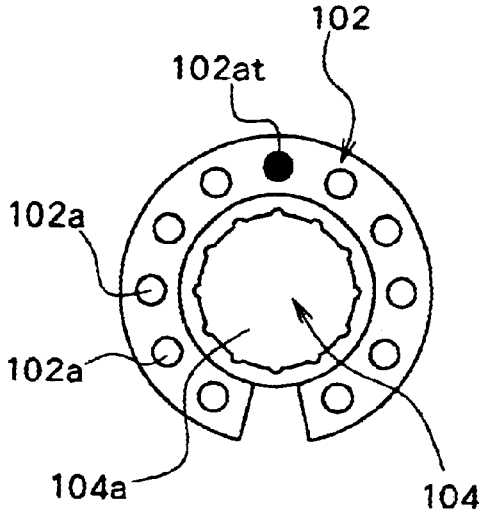
Fig. 7A (PRIOR ART)
FIG. 7A is a view showing an example indicator of a conventional switch device.
Figure 7B:
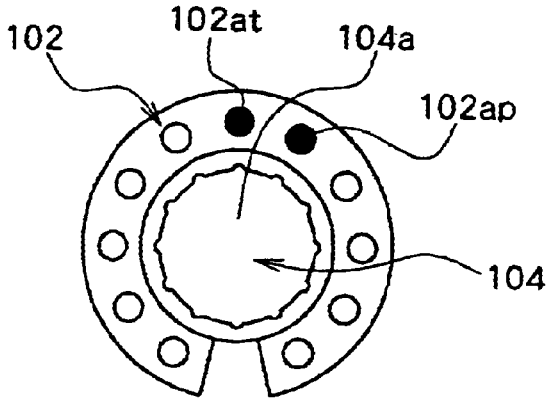
Fig. 7B (PRIOR ART)
FIG. 7B is a another view of the indicator of the conventional switch device.
Figure 7C:
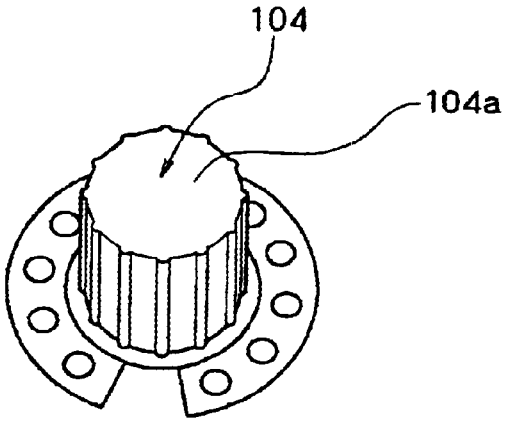
Fig. 7C (PRIOR ART)
FIG. 7C is a view for explaining how a blind spot region is generated by a knob in the conventional switch device.
Figure 7D:
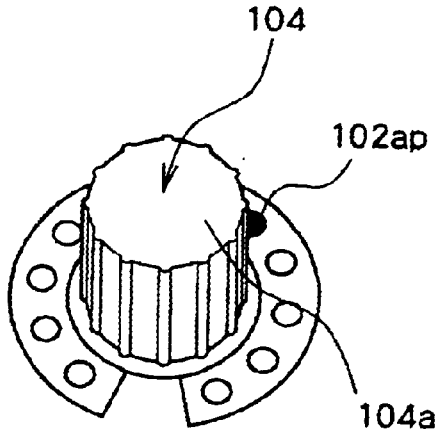
Fig. 7D (PRIOR ART)
FIG. 7D is a view for explaining how a blind spot region is generated by a knob in the conventional switch device.

FIGS. 1A to 1D show a rotary volume switch (hereinafter referred to simply as a "switch") 10 disposed on the mixer device 100 (see FIG. 6) as a switch device having an indicator according to the present embodiment. Here, the appearance of the switch 10 including an indicator 12 is the same as that shown in FIGS. 7A to 7D. An operation knob (hereinafter referred to simply as a "knob") 10*a* of the rotary switch 10 has a diameter of approximately 10 mm, and a height of approximately 20 mm, for example. The indicator 12 which is composed of a plurality of light emitting elements (for example, LEDs 12*a*) or the like is disposed in a circle around the knob 10*a*. In the present embodiment, as shown in FIG. 1A, for example, the indicator 12 is composed of eleven LEDs 12*a*, of which LED $\mathbf{12}a_{min}$ at the left end in the drawing indicates the minimum operation amount "volume 0" of the knob 10*a* and LED $\mathbf{12}a_{max}$ at the right end in the drawing indicates the maximum operation amount "volume 10" of the knob 10*a*. In accordance with the operation amount of the knob 10*a*, the position of an LED 12*a* which lights up sequentially moves in the order of LED $\mathbf{12}a_{min}$, $\mathbf{12}a_1$, $\mathbf{12}a_2$, $\mathbf{12}a_3$, $\mathbf{12}a_4$, . . . $\mathbf{12}a_9$, and $\mathbf{12}a_{max}$. Therefore, LED $\mathbf{12}a_{min}$ is let when the operation amount corresponds to "volume 0", and LED $\mathbf{12}a_{max}$ is let when the operation amount corresponds to "volume 10".

The present embodiment is characterized as follows. Specifically, when the indicator 12, whose indication state is changed in accordance with the operation amount of the knob 10*a*, includes a special indication region indicating a specific operation amount of the knob 10*a* and a visible region which is always visible, and if the lighting of the indicator 12 reaches the special indication region, the indication state of part of the visible region is changed so that the indication content in the special indication region is expressed in the visible region which is easier to recognize, thereby increasing the visibility.

First, an example will be described in which, when the line of sight of an operator is blocked by the knob 10*a* so that a blind spot region which hides an area of the indicator 12 including the special indication region, the indication content in this blind spot region is displayed using the visible region, to thereby increase the visibility.

Figure 1B:
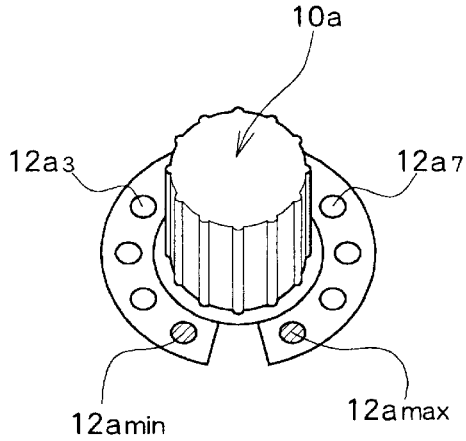
FIG. 1B is a perspective view showing an example of the operation amount of a switch device according to the embodiment of the present invention reaching a blind spot region.
Figure 1C:
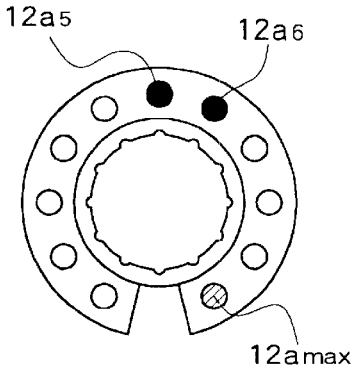
FIG. 1C is a top view showing an example wherein the operation amount of a switch device according to the embodiment of the present invention exceeds an attention point.
Figure 1D:
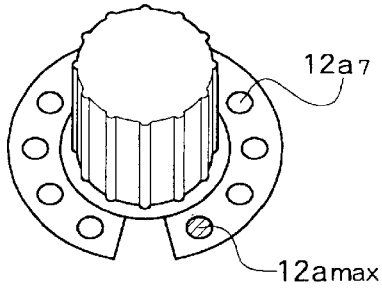
FIG. 1D is a perspective view showing an example wherein the operation amount of a switch device according to the embodiment of the present invention exceeds an attention point.

As described above with reference to the example shown in FIGS. 7A to 7D, in the switch 10 disposed on the operation panel of the mixer device 100, depending on the position of the indicator 12 and the standing position or posture of the operator, the standing knob 10*a* may block a part of the operator's view of the indicator 12 to thereby generate a blind spot region (special indication region), as shown in FIG. 1B. More specifically, in the example of FIG. 1B, LED $\mathbf{12}a_4$ to LED $\mathbf{12}a_6$ are located within the blind spot region, and an operator cannot recognize that, for example, an LED 12*a* within this blind spot region is lit up to indicate the operation state of the knob 10*a*.

Accordingly, in accordance with the present embodiment, the state of the LED 12*a* in the blind spot region is displayed using the indicators in the visible region which is always visible to the operator, so that the operator can easily recognize the indication state of the blind spot region.

In FIG. 1B, the visible region includes LED $\mathbf{12}a_{mim}$ to LED $\mathbf{12}a_3$ and LED $\mathbf{12}a_7$ to LED $\mathbf{12}a_{max}$, and an LED 12*a* in this visible region is used to express the state of the blind spot region. In the specific example shown in FIG. 1B, two LEDs, namely LED $\mathbf{12}a_{mim}$ and LED $\mathbf{12}a_{max}$ which are positioned at the ends of the visible region, are used to express the state of the blind spot region. In general, the end portions of the visible region are easy to recognize and can facilitate the recognition of change. Referring to FIG. 1A, an LED 12*a* which lights up is expressed as ●, and an LED 12*a* which lights out is indicated as ○. Dim lighting can be achieved by, for example, decreasing the electric current flowing through the LED 12*a*. In the figures, the dimly lighted state of LED 12*a* is illustrated using hatching.

There are cases where an attention point indicative of a point which requires attention, such as a reference (neutral) point and a threshold value for the operation amount of the knob 10*a*, is provided in the special indication region indicating a specific operation amount of the knob 10*a*. The attention point is often located in the center or near the center of the entire region of the indicator 12, and may therefore be located within the blind spot region. In the example shown in FIG. 1A, the attention point is provided in the center of the indicator 12, namely at LED $\mathbf{12}a_5$, and remains continuously lit to identify an attention point, irrespective of the operation amount of the knob 10*a*.

According to the present embodiment, when the lighting of LED 12*a* reaches the blind spot region by operation of the knob 10*a*, LED $\mathbf{12}a_{min}$ and/or LED $\mathbf{12}a_{max}$ are lit (dimly). In this embodiment, the lighting of the indicator 12 is controlled by a control section (lighting-up control circuit) M which includes a CPU for reading the operation amount of the switch 10. FIGS. 1A and 1B show a state in which the lighting of LED 12*a* reaches the blind spot region by the operation of the knob 10*a* and the operation amount exactly corresponds to the attention point. At this point, LED $\mathbf{12}a_{min}$ and LED $\mathbf{12}a_{max}$ light up simultaneously in order to express this state. In a case where the operation amount reaches the blind spot region, but does not reach the attention point or passes the attention point, LED $\mathbf{12}a_{min}$ or LED $\mathbf{12}a_{max}$ is used to express such a state in a different manner. For example, in a case shown in FIGS. 1C and 1D where the operation amount exceeds the attention point, LED 12*a* in the visible region lights up in order to indicate that the operation amount is within the blind spot region. In this case, however, in order to indicate that the operation amount exceeds the attention point, only LED $\mathbf{12}a_{max}$ is lit. Similarly, when the operation amount is within the blind spot region but does not reach the attention point, only LED $\mathbf{12}a_{min}$ is lit. In this manner, the indication state in the blind spot region is indicated using the indication patterns of LED $\mathbf{12}a_{min}$ and LED $\mathbf{12}a_{max}$, so that the state in the blind spot region can be accurately expressed even when the blind spot region ranges over a relatively wide area. Of course, when the blind spot region covers a wider range and the operation amount in this blind spot region is set in a multi-stage manner about the attention point, LED $\mathbf{12}a_1$ and LED $\mathbf{12}a_9$ may be used in addition to LED $\mathbf{12}a_{min}$ and LED $\mathbf{12}a_{max}$, so that a combination of these four LEDs 12*a* can express the state which is actually indicated in the blind spot region, namely, the degree of deviation of the operation amount from the attention point, using the visible region. It is of course possible to use more LEDs 12*a* unless the state in the blind spot region is indicated in the visible region in a complex manner. On the other hand, when only one LED 12*a* is included in the blind spot region, LED $\mathbf{12}a_{min}$, LED $\mathbf{12}a_{max}$, or any one of LEDs 12*a* located within the visible region may be used to express the state in the blind spot region.

Figures 1E, 1F, 1G, 1H, 1I:
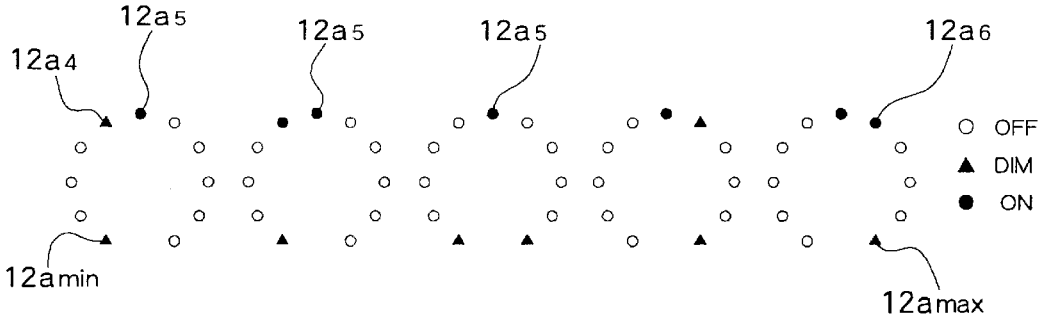
FIG. 1E is a view for explaining a light emission pattern of an indicator.
FIG. 1F is a view for explaining a light emission pattern of the indicator.
FIG. 1G is a view for explaining a light emission pattern of the indicator.
FIG. 1H is a view for explaining a light emission pattern of the indicator.
FIG. 1I is a view for explaining a light emission pattern of the indicator.

FIGS. 1E to 1I show example lighting patterns of the LED $\mathbf{12}a_{min}$ and LED $\mathbf{12}a_{max}$ after the operation amount reaches the blind spot region. It should be noted that when such a state is schematically shown in FIGS. 1E to 1H and also in the following drawings, a brightly lit LED 12*a* is indicated with a "●", an LED 12*a* which is not lit is indicated by a "○", and a dimly lit LED 12*a* is shown by a "▲". For example, when the operation amount of the knob 10*a* reaches the blind spot region but does not reach the attention point, namely when the light emitting action in accordance with the operation amount of the knob 10*a* is achieved by LED $\mathbf{12}a_4$, LED $\mathbf{12}a_{min}$ lights up dimly so as to allow visible recognition of such a situation, as shown in FIGS. 1E and 1F. Then, when the operation amount of the knob 10*a* reaches LED $\mathbf{12}a_5$ indicative of the attention point, both LED $\mathbf{12}a_{min}$ and LED $\mathbf{12}a_{max}$ light up dimly, as shown in FIG. 1G. Further, after the operation amount of the knob 10*a* increases to thereby pass the attention point and until it enters the blind spot region, only LED $\mathbf{12}a_{max}$ lights up dimly as shown in FIGS. 1H and 1I so as to indicate that the operation amount has passed the attention point but is still within the blind spot region.

As described above, even when a blind spot region (special indication region) blocking part of the indicator 12 is generated by the knob 10*a* itself, an LED 12*a* located in the visible region can be used to express the state of the indicator in the blind spot region, so that the operator can recognize the operation amount of the switch 10. This can be accomplished with a simple structure and without requiring the operator change their posture or the like. Further, because LED $\mathbf{12}a_{min}$ and LED $\mathbf{12}a_{max}$ which are used to indicate the operation amount of the knob 10*a* are also used to indicate the state in the blind spot region using the visible region, there is no increase in the number of components or cost.

While LED $\mathbf{12}a_{min}$ and LED $\mathbf{12}a_{max}$ light up dimly when the state in the blind spot region is expressed in the visible region in the examples shown in FIGS. 1A to 1D, it is also possible to cause LED $\mathbf{12}a_{min}$ and LED $\mathbf{12}a_{max}$ to fully light up (bright lighting-up) or to blink. It is further possible to combine these types of lighting to discriminate between different amounts or types of operation. For example, a blinking LED 12*a* can be used to express the change, thereby increasing visibility.

Figure 2:
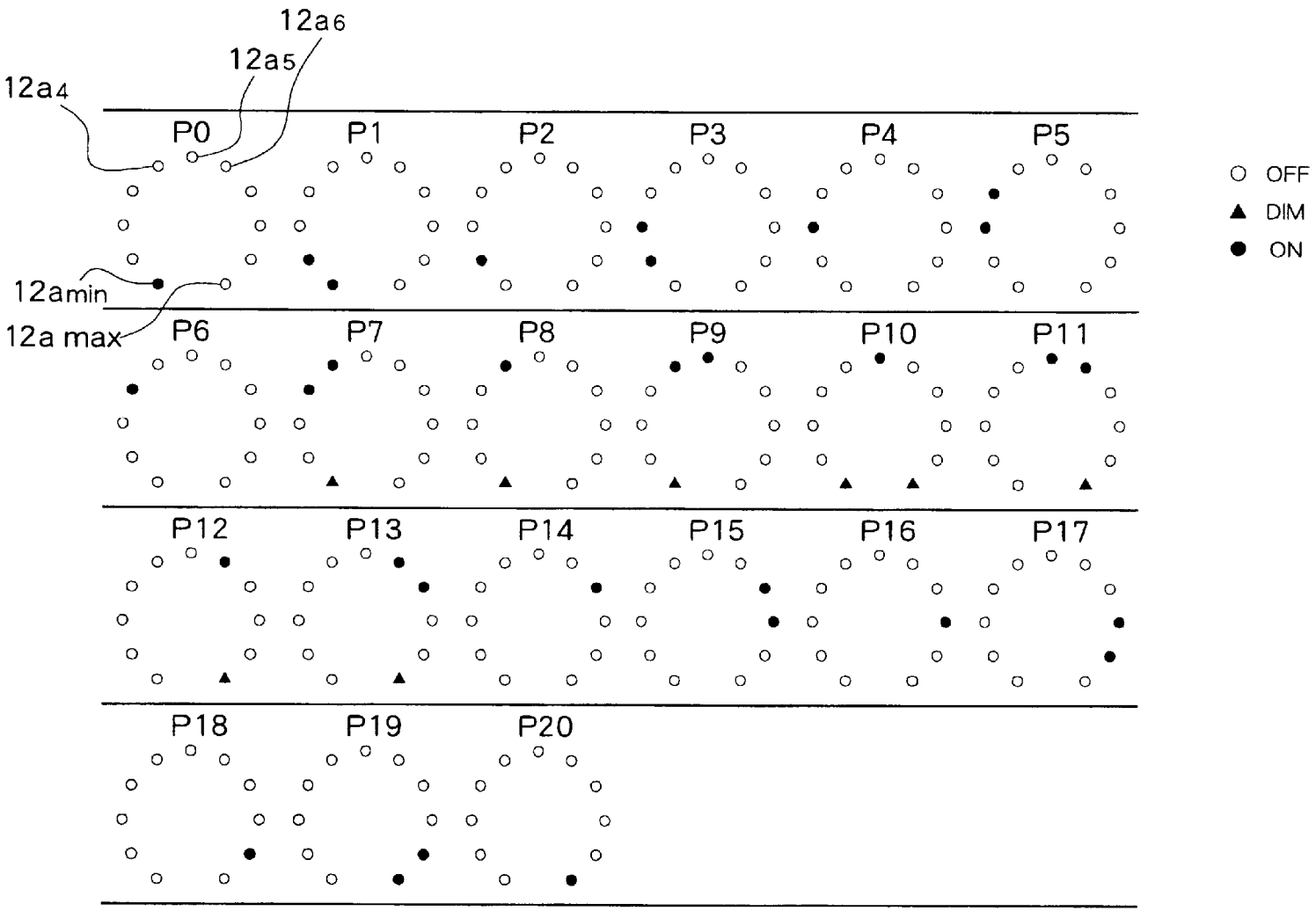
FIG. 2 is a view for explaining a light emission pattern of an indicator of a switch device according to the embodiment of the present invention.

In the example shown in FIG. 1A, only a single LED 12*a* (other than LED $\mathbf{12}a_5$ indicative of the attention point and LED $\mathbf{12}a_{min}$ and LED $\mathbf{12}a_{max}$ indicative of the state of the blind spot region) is lit at the point shown in the drawing, and increase and decrease of the operation amount of the knob 10*a* is expressed by repeating bright and dim lighting of the LED in accordance with a change of the operation amount of the knob 10*a*. For example, when, after the knob 10*a* is operated to cause LED $\mathbf{12}a_2$ to fully light up, the knob 10*a* is further operated toward the MAX direction, then LED $\mathbf{12}a_3$ is also fully lit. When, for example, the operation amount corresponding to full lighting up of LED $\mathbf{12}a_3$ after LED $\mathbf{12}a_2$ has been fully lit is an operation amount "1", the operation amount required for causing LED $\mathbf{12}a_3$ to be dimly lit after full lighting-up of LED $\mathbf{12}a_2$ can be regarded as an operation amount "+0.5". Similarly, the operation amount required for causing LED $\mathbf{12}a_3$ to light up fully after LED $\mathbf{12}a_3$ has been dimly lit can also be regarded as an operation amount "+0.5". In other words, the operation amount "0.5" of the knob 10*a* is substantially indicated using a combination of bright and dimmed LEDs. Alternatively, the operation amount "0.5" may be similarly indicated only by full lighting-up as shown in FIG. 2. In this case, decrease or increase of the operation amount of the knob 10*a* is expressed by alternately lighting up one or two LEDs 12*a*.

Referring to FIG. 2, the state P0 shows the minimum operation amount "volume 0" of the knob 10*a* and the state P20 shows the maximum operation amount "volume 10" of the knob 10. In the example of FIG. 2, the blind spot region includes LED $\mathbf{12}a_4$ to LED $\mathbf{12}a_6$ similar to the foregoing example, and the state in which after the operation amount of the knob 10*a* reaches the blind spot region and until it exits the blind spot region is indicated by LED $\mathbf{12}a_{min}$ and LED $\mathbf{12}a_{max}$ located within the visible region. Specifically, during the states P7 to P9, that is, after the operation amount reaches the blind spot region and immediately before the operation amount corresponds to the value associated with the attention point, only LED $12a_{min}$ is lit. Then, when the operation amount corresponds with the attention point at P10, both LED $12a_{min}$ and LED $12a_{max}$ light up. Further, during the states P11 to P13, that is, after the operation point passes the attention point and until the operation amount exits the blind spot region, only LED $12a_{max}$ lights up. It should be noted that while LED $12a_{min}$ or LED $12a_{max}$ is dimly lit (DIM) so as to indicate the state of the blind spot region, it is preferable that LED $12a_{min}$ or LED $12a_{max}$ be fully lit up when they are used to indicate the minimum or maximum operation amount.

Figure 3:
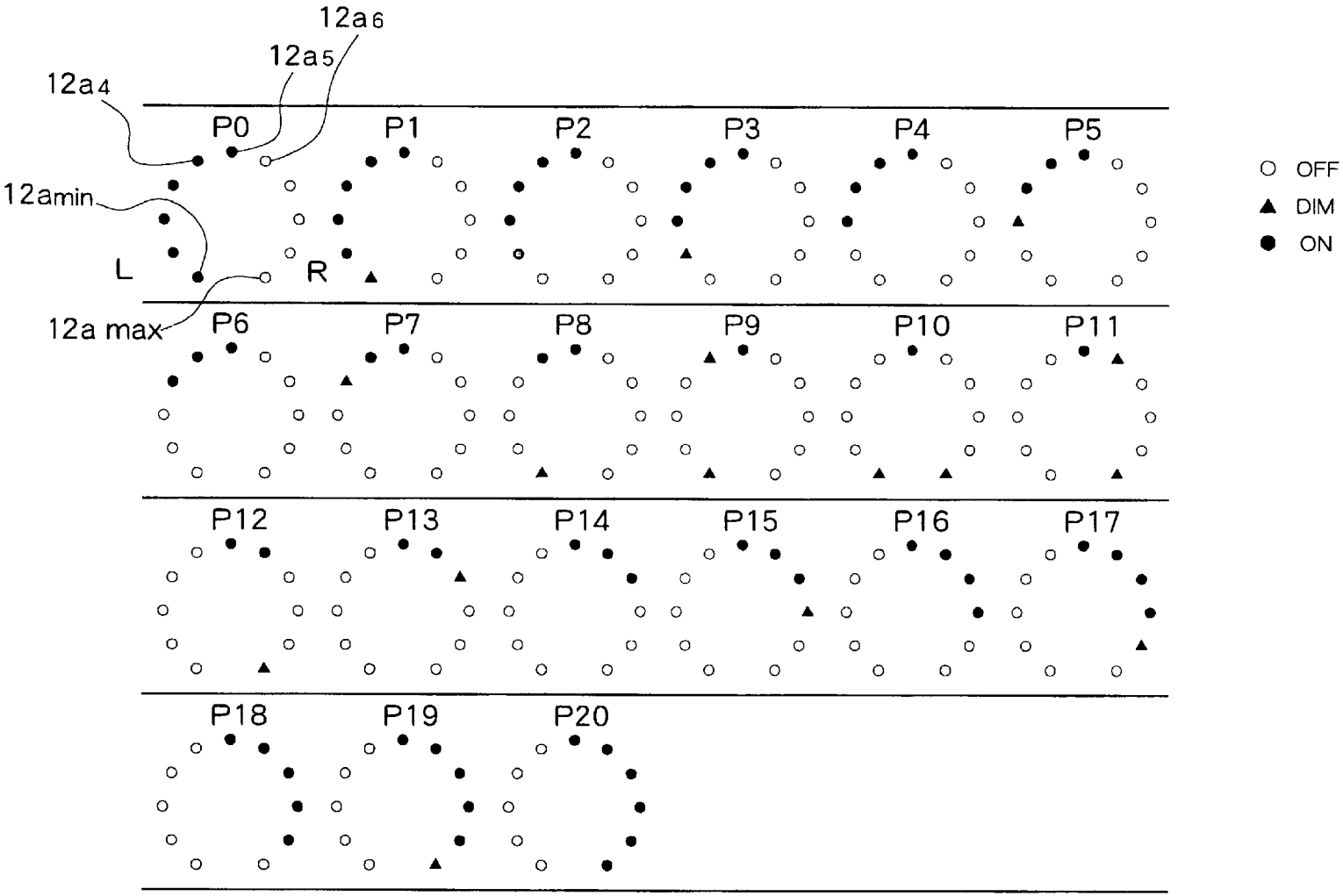
FIG. 3 is a view for explaining another light emission pattern of the indicator of a switch device according to the embodiment of the present invention.

Referring to FIG. 3, other light emitting patterns of the indicator 12 are shown. FIG. 3 illustrates an example of a switch 10 used for left and right (L-R) volume balancing, for example. Here, LED $12a_5$ indicative of the attention point is a neutral point between L and R. In the example of FIG. 3, similar to the example of FIG. 2, LED $12a_4$ to LED $12a_6$ of the indicator 12 are within the blind spot region because of the knob 10*a*, and are not directly visible to the operator. Accordingly, in state P10, in which is the L-R balanced (neutral) state, LED $12a_{min}$ and LED $12a_{max}$ light up dimly (DIM) in order to indicate the state LED $12a_5$ using the visible region. Then, as the knob 10*a* is turned counterclockwise, the array or light emitting LEDs 12*a* on the left side increases as shown in states P9 to P0, which indicates that volume is unbalanced and has deviation to the left (L). As the knob 10*a* is turned clockwise, on the other hand, the array or light emitting LEDs 12*a* on the right side increases as shown in states P11 to P20, which indicates that the volume is unbalanced and has a deviation to the right (R). At this time, it is, of course, possible that LED $12a_{min}$ or LED $12a_{max}$ be dimly lit to indicate the state of the indicator 12 of the blind spot region which is not directly visible from the operator, until the leading end of the light emitting array exits the blind spot region.

Because both indication patterns of FIGS. 2 and 3 can be used to indicate the levels on right and left sides of the state P10 which serves as a center level, it is possible, for example, to express the L-R volume balance using the indication pattern shown in FIG. 2, while the indication pattern shown in FIG. 3 is used to indicate the operation amount "0" to "−10" by operating the switch toward the left side of the state P10 and indicate the operation amount "0" to "+10" by operating the switch toward the right side of the state P10, with the state P10 being used as a reference position, namely as the operation amount "0". In such a case, it is assumed that the operation amount required from full lighting-up to DIM light-up of adjacent LEDs is an operation amount "1".

Figure 4:
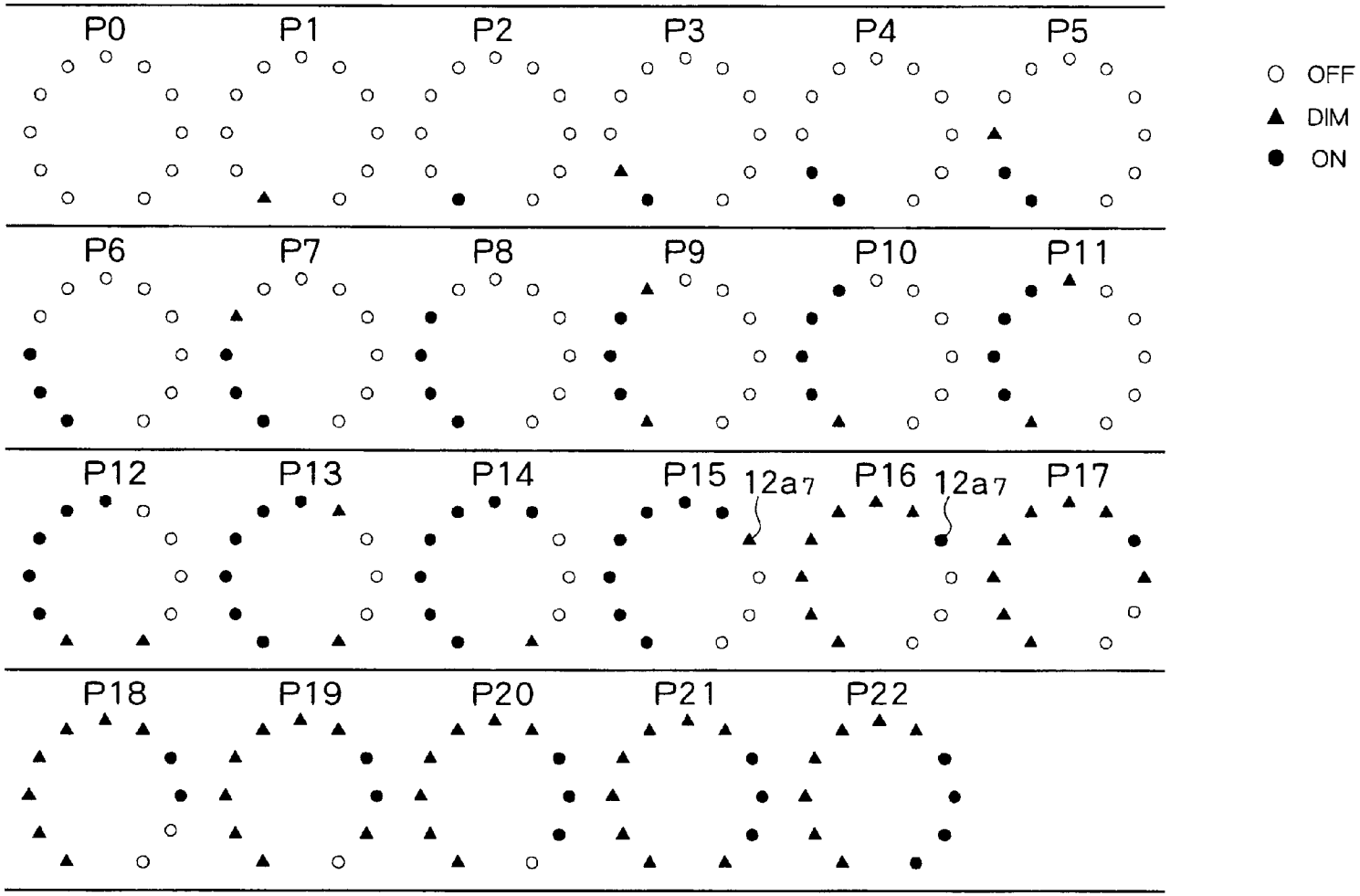
FIG. 4 is a view for explaining still another light emission pattern of the indicator of a switch device according to the embodiment of the present invention.

FIG. 4 illustrates still another example light emission pattern of the indicator 12. The blind spot region and the visible region are set in the same manner as in the example of FIG. 3. In the example of FIG. 4, however, the attention point is not located at the center of the blind spot region, and is located, for example, at LED $12a_7$ which is included in the visible region, as shown in the state P15. The example of FIG. 4 is configured such that not only the state of the indicator 12 within the blind spot region is indicated using LED $12a_{min}$ or LED $12a_{max}$, but also whether or not the operation state of the knob 10*a* exceeds the attention point. First, once the indication by the indicator 12 enters the blind spot region, the lighting-up pattern of LED $12a_{min}$ or LED $12a_{max}$ is changed about the center of the blind spot region as shown in states P9 to P14, so that the operation amount in the blind spot region can be expressed in the visible region. On the other hand, the array of light emission of the indicator 12, which is increased or decreased in accordance with the operation amount of the knob 10*a*, is formed such that all the LEDs 12*a* through which the leading end of the array has passed light up fully until the array reaches the attention point at LED $12a_7$. When the array reaches the attention point, only LED $12a_7$, which is the attention point, fully lights up, and all the other lit LEDs, namely LED $12a_{min}$ to LED $12a_6$, are dimly lit. Subsequently, $12a_7$ to LED $12a_{max}$ following the attention point light up fully in accordance with the operation amount of the knob 10*a*, thereby increasing the light emission array. When the knob 10*a* is operated counterclockwise from the LED $12a_{max}$ side, the state of light emission sequentially changes from P22 to P0. It should be noted that the example of FIG. 4 shows a case wherein all the LEDs 12*a* light out at the level of "volume 0".

As described above, by appropriately selecting the light emission pattern of the LEDs 12*a* constituting the indicator 12, the state of the blind spot region and the state of the attention point located outside the blind spot region can be separately indicated. Of course, LED 12*a* may emit light in the pattern shown in FIG. 4, even when the attention point is located within the blind spot region as shown in FIG. 3 and so on. Further, when LEDs 12*a* emit light in the pattern shown in FIG. 4 and the attention point is located within the blind spot region, after the change of the indication state of the indicator 12 reaches the blind spot region, the indication state using the visible region is varied among cases wherein the indication of the indicator does not reach the attention point, wherein the indication of the indicator reaches the attention point, and where the indication of the indicator passes the attention point. In this manner, further detailed indication of the indicator for the blind spot region can be performed using the visible region.

Further, the visibility concerning the attention point can be increased regardless as to whether or not the blind spot region is generated. For example, when an attention point is set to LED $12a_7$ and a region including this LED $12a_7$ corresponds to the special indication region, LED $12a_{min}$ or LED $12a_{max}$ is caused to light up dimly depending on whether or not the operation amount reaches the special indication region. More specifically, when the operation amount of the knob 10*a* approaches the amount corresponding to LED $12a_7$, just LED $12a_{min}$ is dimly lit. When the operation amount of the knob 10*a* completely reaches LED $12a_7$, which is the attention point, both LED $12a_{min}$ and LED $12a_{max}$ are dimly lit. Then, when the operation amount of the knob 10*a* passes the attention point, just LED $12a_{max}$ is dimly lit. Of course, the position of the attention point can be selected as necessary and desired. Further, when a predetermined region including the LED $12a_7$, which is an attention point is established as a special indication region, the degree of deviation of the operation amount from the attention point may be expressed using indication using a plurality of LEDs 12*a*, full lighting-up, or blinking.

Figure 5:
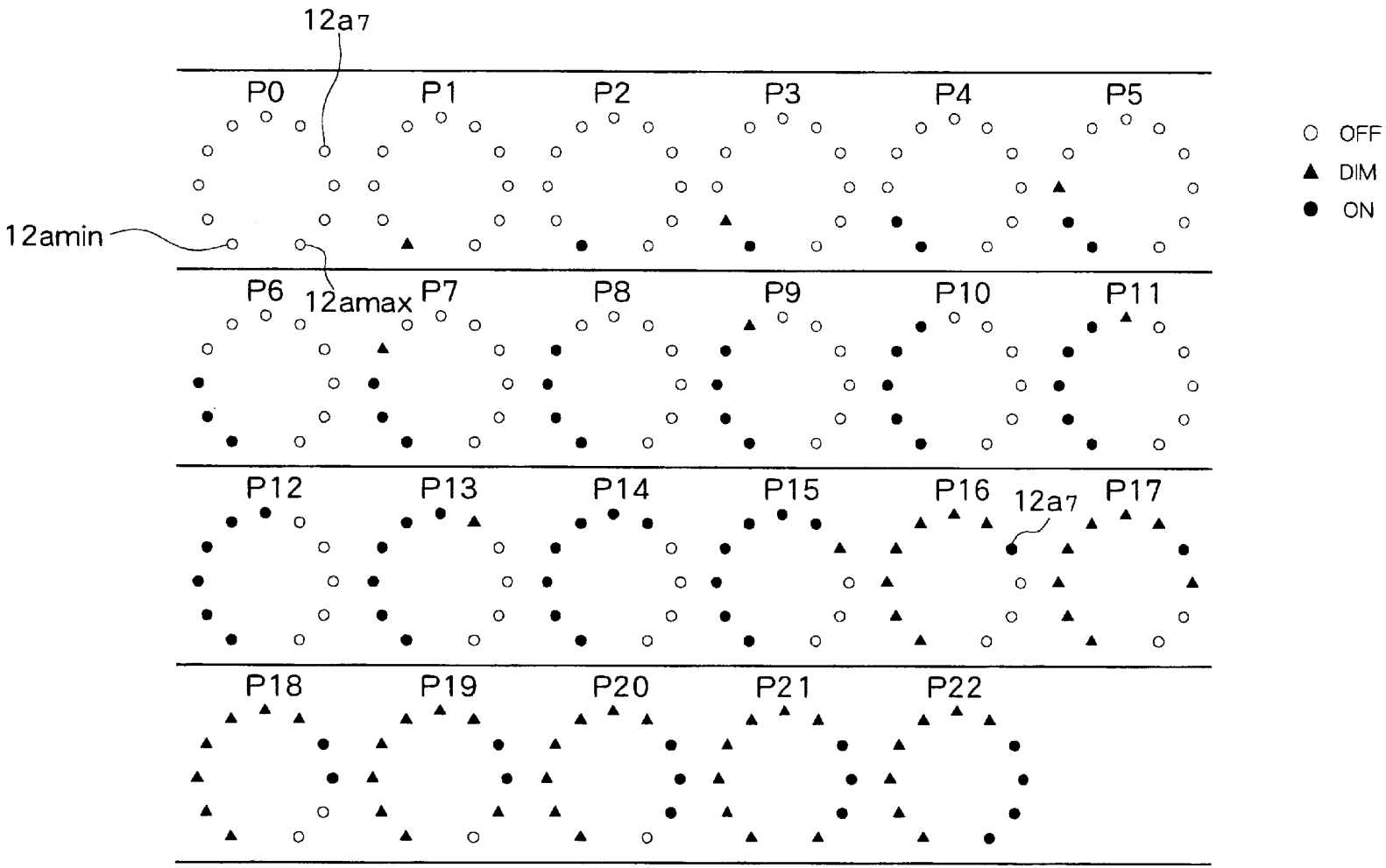
FIG. 5 is a view for explaining a further light emission pattern of the indicator of a switch device according to the embodiment of the present invention.

Further, as shown in FIG. 5, it is also possible to express whether or not the operation amount of the knob 10*a* reaches the special indication region in a manner other than dimly lighting LED $12a_{min}$ or LED $12a_{max}$. In this case, as in the example of FIG. 4, the array of light emission of the indicator 12 which is increased or decreased in accordance with the operation amount of the knob 10*a* is formed such that all the LEDs 12*a* through which the leading end of the array has passed light up fully until the array reaches the attention point at LED $12a_7$. When the array reaches the attention point, only LED $12a_7$, which is the attention point, fully lights up, and all the other LEDs which have been passed, namely LED $12a_{min}$ to LED $12a_6$, are dimly lit.

Subsequently, LED $12a_7$ to LED $12a_{max}$ following the attention point light up fully in accordance with the operation amount of the knob 10*a*, thereby increasing the light emission array. In other words, the state where the attention point LED 12*a*7 included in the special indication region is reached is expressed using other LEDs 12*a* located within the visible region.

As described above, the state of a specific position on the indicator 12, namely the special indication region, can be expressed by changing the indication state in the visible region, so that visibility of the indicator 12 can be improved with a simple structure.

In this manner, by selecting the light emission pattern of LEDs 12*a* constituting the indicator 12 to express a specific position on the indicator 12, such as the state of the special indication region, it is possible for an operator to instantly and accurately recognize the operation state of the switch 10. In particular, even when part of the indicator 12 is hidden by the knob 10*a* to thereby generate a blind spot region, among the LEDs 12*a* of the indicator 12 which are already provided to indicate the operation amount of the knob 10*a*, LEDs 12*a* located in the visible region outside the blind spot region are selectively controlled to light up. In this manner, the state of the blind spot region can be indicated using the visible region without increasing the number of components.

Is should be noted that, as described above, the blind spot region generated by the knob 10*a* varies depending on the shape, size, and location of the knob 10*a*. Similarly, the blind spot region also varies depending on other factors, such as the posture of the operator, for example. It is therefore desirable that the control section M is configured such that it can appropriately change the range of the special indication region, such as the blind spot region, which is indicated using the visible region, as necessary and as desired.

While an example in which a switch 10 is applied to a mixer device is described in the present embodiment, the present invention is also applicable to in other situations where a switch having an indicator is used, and can be applied, for example, to an operation panel in an airplane cockpit or surrounding a drivers seat of a vehicle. Wherever a switch has a blind spot region formed by the knob, similar effects can be obtained.

Further, although in the above examples the indicator LEDs are disposed in a circle around the volume switch, a blind spot region is also formed when a linear indicator is disposed behind (on the side away from the operator) of the volume switch. In this case, it is still possible to express the state of the blind spot region using the visible region as in the foregoing embodiment, and similar effects can be obtained.

As described above, even when a blind spot region is generated in a switch device during indication of the operation amount of the switch device by an indicator, the present invention allows the operation amount to be easily recognized without requiring an expensive structure or for the operator to change the posture or the like.

While the preferred embodiment of the present invention has been described using specific terms, such description is for illustrative purposes only, and it is to be understood that changes and variations may be made without departing from the spirit or scope of the appended claims.

What is claimed is:

1. A switch device comprising:

an operation knob for a switch;

an indicator whose indication state is changed in accordance with an operation amount of the operation knob, the indicator including a special indication region indicative of a specific operation amount of said switch and a visible region which is always visible; and a control section for controlling the indicator such that the indication state of the indicator is sequentially changed in accordance with the operation amount of the operation knob, said control section changing the indication state in part of the visible region when the change of the indication state of the indicator reaches the special indication region.

2. A switch device according to claim 1, wherein the special indication region includes a blind spot region in which indication is obstructed by the operation knob as seen from an operator of the switch device; and said control section changes the indication state of part of the visible region when the change of the indication state of the indicator reaches the blind spot region.

3. A switch device according to claim 1, wherein the special indication region includes an attention point indicative of a specific operation state of the switch.

4. A switch device according to claim 3, wherein said control section causes the indication states of the visible region to vary for each of cases wherein the change of the indication state of the indicator does not reach the attention point after the change reaches the special indication region, wherein the change of the indication state of the indicator reaches the attention point after the change reaches the special indication region, and wherein the change of the indication state of the indicator passes the attention point after the change reaches the special indication region.

5. A switch device according to claim 1, wherein said control section uses the visible region to indicate the indication state of the indicator in the special indication region.

6. A switch device according to claim 1, wherein the indication state of part of the visible region is changed by using part of the visible region including end portions when the change of the indication state of the indicator reaches the special indication region.

7. A switch device according to claim 1, wherein the indication state of part of the visible region is changed by controlling lighting-up of the indicator at a predetermined position, when the change of the indication state of the indicator reaches the special indication region.

8. A switch device according to claim 1, wherein the indication state of part of the visible region is changed by controlling blinking of the indicator at a predetermined position, when the change of the indication state of the indicator reaches the special indication region.

9. A switch device according to claim 1, wherein the indication state of part of the visible region is changed by controlling driving of a plurality of elements which constitute the indicator, when the change of the indication state of the indicator reaches the special indication region.

10. A switch device comprising:

an operation knob for a volume switch;

an indicator disposed around said operation knob, whose indication state is changed in accordance with an operation amount of the operation knob, said indicator including a special indication region indicative of a specific operation amount of said volume switch and a visible region which is always visible; and a control section for controlling the indicator such that the indication state of the indicator is sequentially changed in accordance with the operation amount of the operation knob, said control section changing the indication state in part of the visible region when the change of the indication state of the indicator reaches the special indication region.

11. A switch device according to claim 10, wherein the special indication region includes a blind spot region in which indication is obstructed by the operation knob as seen from an operator of the switch device; and said control section changes the indication state of part of the visible region when the change of the indication state of the indicator reaches the blind spot region.

12. A switch device according to claim 10, wherein the special indication region includes an attention point indicative of a specific operation state of the switch.

13. A switch device according to claim 12, wherein said control section causes the indication states of the visible region to vary for each of cases wherein the change of the indication state of the indicator does not reach the attention point after the change reaches the special indication region, wherein the change of the indication state of the indicator reaches the attention point after the change reaches the special indication region, and wherein the change of the indication state of the indicator passes the attention point after the change reaches the special indication region.

14. A switch device according to claim 10, wherein said control section uses the visible region to indicate the indication state of the indicator in the special indication region.

15. A switch device according to claim 10, wherein the indication state of part of the visible region is changed by using part of the visible region including end portions when the change of the indication state of the indicator reaches the special indication region.

16. A switch device according to claim 10, wherein the indication state of part of the visible region is changed by controlling lighting-up of the indicator at a predetermined position, when the change of the indication state of the indicator reaches the special indication region.

17. A switch device according to claim 10, wherein the indication state of part of the visible region is changed by controlling blinking of the indicator at a predetermined position, when the change of the indication state of the indicator reaches the special indication region.

18. A switch device according to claim 10, wherein the indication state of part of the visible region is changed by controlling driving of a plurality of elements which constitute the indicator, when the change of the indication state of the indicator reaches the special indication region.

* * * * *